United States Patent [19]

Perkins

[11] 4,287,967

[45] Sep. 8, 1981

[54] SELF-SUPPORTING AND SELF-CONTAINED ELEVATOR

[75] Inventor: Rex H. Perkins, Victoria, Australia

[73] Assignee: Sanscord Australia Pty. Limited, Victoria, Australia

[21] Appl. No.: 46,948

[22] Filed: Jun. 8, 1979

[51] Int. Cl.[3] ..... B66B 11/04

[52] U.S. Cl. ..... 187/24; 254/98

[58] Field of Search ..... 187/73, 24, 25, 17, 187/1 R, 6, 96; 254/7 C, 98, 99; 52/79.1, 79.12

[56] References Cited

U.S. PATENT DOCUMENTS

| | | | |
|---|---|---|---|
| 2,187,390 | 1/1940 | Anderson et al. | 187/24 |
| 2,268,800 | 1/1942 | Butzien | 187/25 |
| 2,988,059 | 6/1961 | Wysong, Jr. | 180/146 |
| 3,121,345 | 2/1964 | Zeigler et al. | 180/146 |
| 3,768,628 | 10/1973 | Bross | 187/24 |
| 3,881,575 | 5/1975 | Manaugh | 187/25 |

*Primary Examiner*—Robert J. Spar
*Assistant Examiner*—Kenneth Noland
*Attorney, Agent, or Firm*—Lowe, King, Price & Becker

[57] ABSTRACT

This invention concerns a self-supporting and self-contained elevator suitable for the transfer of loads from one level to another of a building structure. The elevator is capable of being preassembled and placed into an existing well or space provided in a structure. The invention utilizes rigid guide devices for control of both the speed and direction of movement of the elevator. In the instance of failure of such guide devices, further movement of the elevator is precluded. The arrangement of the invention functions without reliance on conventional hoisting devices in the form of cables or ropes, effectively precluding the need for incorporation of sophisticated safety devices to operate to stop the elevator in the instance of failure of the hoisting device.

6 Claims, 5 Drawing Figures

SELF-SUPPORTING AND SELF-CONTAINED ELEVATOR

BACKGROUND OF THE INVENTION

1. Field of the Invention

The present invention relates to means for the transfer of loads from one level to another. More particularly the invention relates to means allowing for the transfer of loads between two adjacent floors or storeys of a building structure.

2. Description of the Prior Art

A conventional elevator, of the type suitable for transferring loads from one level to another, depends for its actual operation upon the utilisation of steel cables, hoisting ropes or the like. Such elevators in general may be seen to comprise a power operated device for lifting and lowering loads and are made up of a so-called car or cage which is arranged so as to run between guide rails extending between the levels under consideration. The car or cage itself is by convention suspended from steel hoisting ropes or cables. The weight of the car and its load is, in practice, approximately counterbalanced by a so-called counterweight. The actual weight to be hoisted by the drive motor may therefore be seen never to equal the total weight of the car and passengers (or load) but rather is equal to merely the relatively small difference which exists between the counterweight and the weight of the loaded car.

By reason of the use of steel hoisting cables, ropes and the like the relevant government authorities require the incorporation of sophisticated and virtually fail-safe safety devices and safe-guards in elevators of this general type. Some elevators, for example, are equipped with a safety rope which runs in an endless loop around pulleys positioned at the top and bottom respectively of the lift well or shaft. This safety rope is then secured to the lift or elevator car. In the event of fracture or failure of the hoisting rope or cable the car will drop (under the influence of gravity). This drop will cause the pulleys of the safety rope to rotate more rapidly. A centrifugal governor connected to the safety rope pulley positioned at the top of the lift shaft will then serve to actuate a switch which will set the safety devices in operation whereby to arrest the downward motion of the car. In one example this arresting effect is achieved by means of powerful jaws adapted to act on and grip the guide rails.

SUMMARY OF THE INVENTION

Various other safety devices are also generally provided in modern elevators of this general type. For example, limit switches may be provided to prevent over-travel of the car beyond the desired level, door interlocks may be provided to prevent the car from actually starting until the doors or the like are securely closed, etc.

Further problems arise when an elevator is specifically required, for example, for use and installation in a two-storey building, be that building a private house, flats, offices or perhaps even storage facilities. Modern elevators are particularly designed for usage in multi-storey buildings and, in the result, it is generally extremely difficult and accordingly expensive to obtain a smaller unit for usage in a two-storey situation. As pointed out above such smaller units may be required, for example, by smaller firms for the purposes of transporting loads, in the form of personnel, stationary and/or other material between adjacent floors. Alternatively, in the domestic situation, such small units would be particularly appropriate for the transport of either elderly or otherwise incapacitated people between adjacent floors of a multi-storey home or building. If no such facility for transport is provided, then such elderly or incapacitated people would in essence be virtually confined to a particular storey of the structure, a dreary existence indeed.

The present invention seeks to provide an elevator or load transfer means which is particularly suited for usage between adjacent levels in a structure. The invention further seeks to provide such a load transfer means or elevator which achieves the desired result in an efficient manner and by the utilisation of apparatus the cost of which brings it within reach of both the business and domestic sections of our community.

The present applicant's arrangement seeks to avoid the need for the use of ropes, cables and the like in elevator or load transfer equipment. Such what may be termed "hoisting means", generally in the form of ropes or cables are, of course, susceptible to breakage. The present arrangement, by eliminating the need for these elements, results in an increase in both the efficiency of the overall system and the degree of safety afforded thereby. Despite the elimination of such elements as hoisting cables, ropes and the like, the present applicant's arrangement has nevertheless been found to comply fully with the requirements of the relevant government authority or instrumentality as regards structural and operational safety.

The present invention further seeks to provide an elevator which will not drop in the event of power failure, but will rather automatically stop at the level reached or attained at that particular point of time.

The present invention furthermore seeks to provide an elevator or load transfer means which is adaptable for ready installation into an existing building, or alternatively may be readily fitted to an outer wall of an existing building. In order to achieve this result, an elevator or load transfer means in accordance with the present invention is adapted for assembly prior to transport to the site where installation is required.

In accordance with the present invention there is provided an apparatus for the transfer of loads from one level to another, said apparatus including: platform means for supporting said load or loads; guide means for controlling the path and speed of movement of said platform means between said levels; and drive means operable to move said platform means between said levels.

BRIEF DESCRIPTION OF THE DRAWINGS

In order that the present invention may be more clearly understood and put into practical effect there shall now be described in detail preferred constructions of a load transfer means in accordance with the invention. The ensuing description is given by way of non-limitative example only and is with reference to the accompanying drawings, wherein.

DESCRIPTION OF THE PREFERRED EMBODIMENTS

Figure 1:
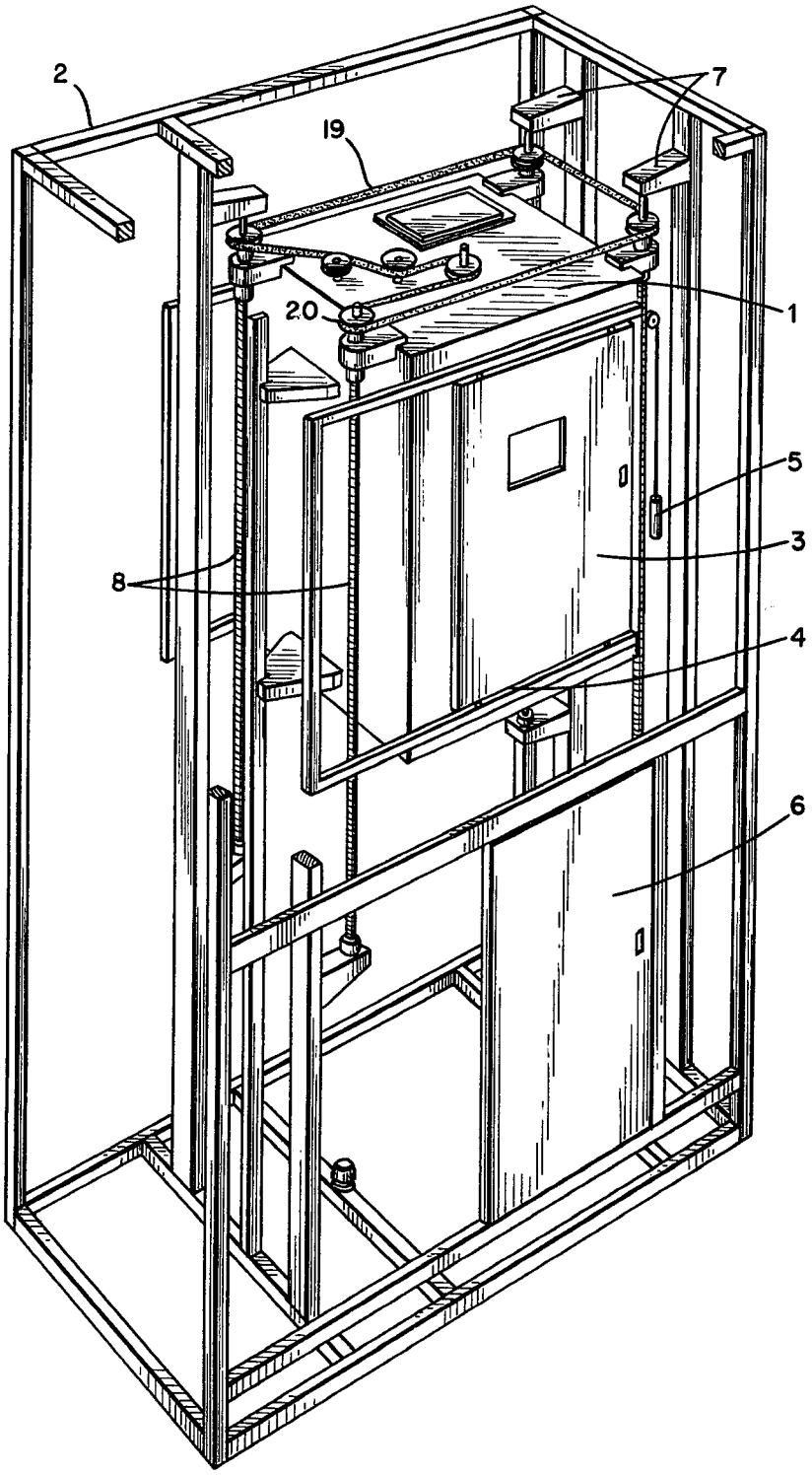
FIG. 1 is a perspective view from above of a load transfer system in accordance with the present invention, showing an appropriate well or shaft and a platform means in the form of a so-called car adapted to move between two levels of a building structure.

In an especially preferred form of the invention, as illustrated for example in FIG. 1, a load transfer means includes a so-called car or cage 1 adapted for location within an outer tower or frame 2 whereby to allow for movement of the car 1 between two floor positions. The transfer means thus arranged may be of a modular construction, whereby to allow for transport in its assembled condition to a site for installation in the interior of a building, or alternatively for ready attachment to the side of a building.

As illustrated in the drawings the car 1 preferably is made up of a box-like enclosure having sliding doors 3 provided thereon to allow for entry thereinto. In one arrangement in accordance with the invention a sliding door 3 is provided at one side of the box-like enclosure. However, in an alternative arrangement a corresponding sliding door may be provided at both the front and rear sides thereof, whereby to allow for ready access from both front and rear. In other words, the car 1 may be provided either as a walk-through unit having doors to both sides thereof, or as a come-back model, having doors to one side only.

Figure 2:
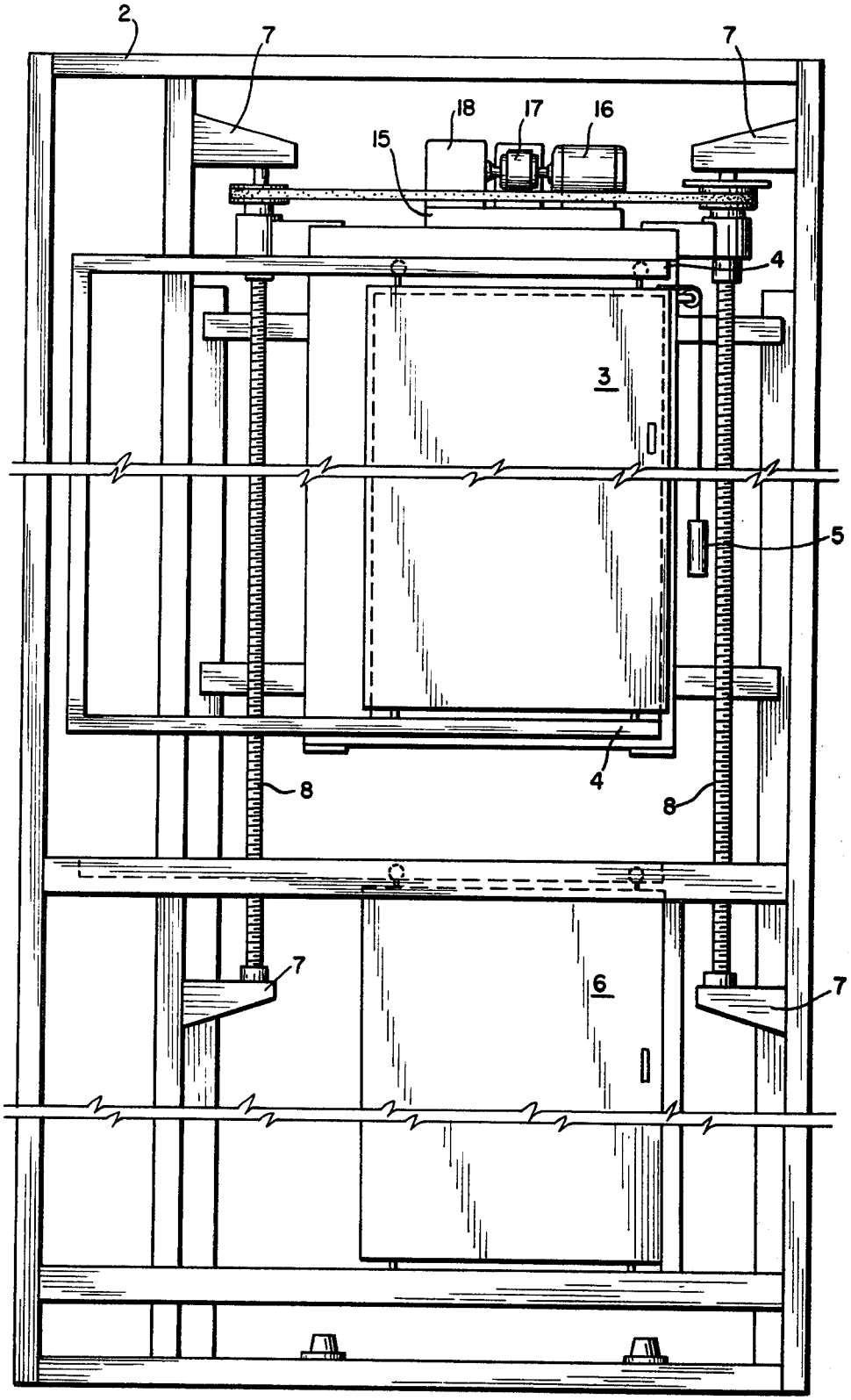
FIG. 2 is a front elevational view of the transfer system illustrated in FIG. 1.
Figure 3:
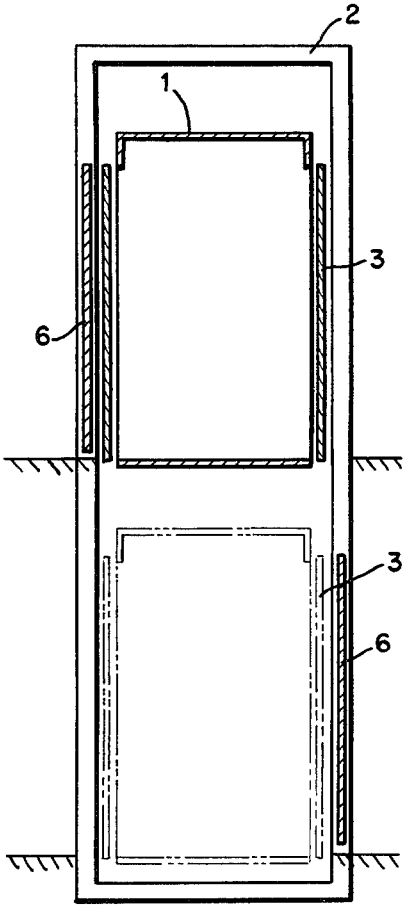
FIG. 3 is a partial elevational view, from the side, of the arrangement of FIGS. 1 and 2, showing the car or platform means in its uppermost position in full lines and in its lowermost position at an adjacent level in broken lines.

In an especially preferred embodiment the or each door 3 of the car 1 is fabricated from aluminium and mild steel sections as a separate unit to be bolted or otherwise affixed to the car 1. If a hand-operated door 3 is desired, this may be achieved by the provision of an appropriately fire-rated door arranged on a so-called Bangor type track 4 and counter-weighted with a dash-pot arrangement 5, as specifically shown in FIGS. 1 and 2. However, if self-opening type doors are desired this may be achieved by fitting the or each door 3 with a torque limited drive.

In addition to the aforementioned door or doors 3, there is preferably also provided, at each level or landing of the arrangement in accordance with the invention, an outer or landing door assembly 6. This landing door assembly 6 may be of a somewhat similar construction to the actual car doors 3, although the assembly 6 is adapted to be bolted to the tower or frame 2 and is preferably fitted with an electro-mechanical type lock whereby to prevent opening thereof at any time when the car or cage 1 is not itself present at the landing. This constitutes a further safety precaution. The landing door assembly may also be provided with a technician's lock release assembly whereby to allow for entry for purposes of service and maintenance.

On opposing sides of the car 1 and adjacent the ceiling thereof there are provided upper mounting brackets 7 for receiving and retaining guide means allowing for the control of movement of the car 1. In an especially preferred arrangement the guide means are in the form of four rolled thread ball bearing screw assemblies, as for example of the type known as Saginaw steering gear available from The General Motors Corporation. In such an arrangement use is made of four fixed Saginaw type screws 8 each having a revolving circulating ball nut associated therewith and attached to the car 1. It should be understood, however, that whilst the preferred embodiment ultiises four such rolled thread ball bearing screw assemblies, two such assemblies might well alternatively be employed. Such an arrangement, however, will not prove as efficient as the aforementioned arrangement utilising four such assemblies, by reason of the possibility of sway and twist introduced thereby.

Figure 5:
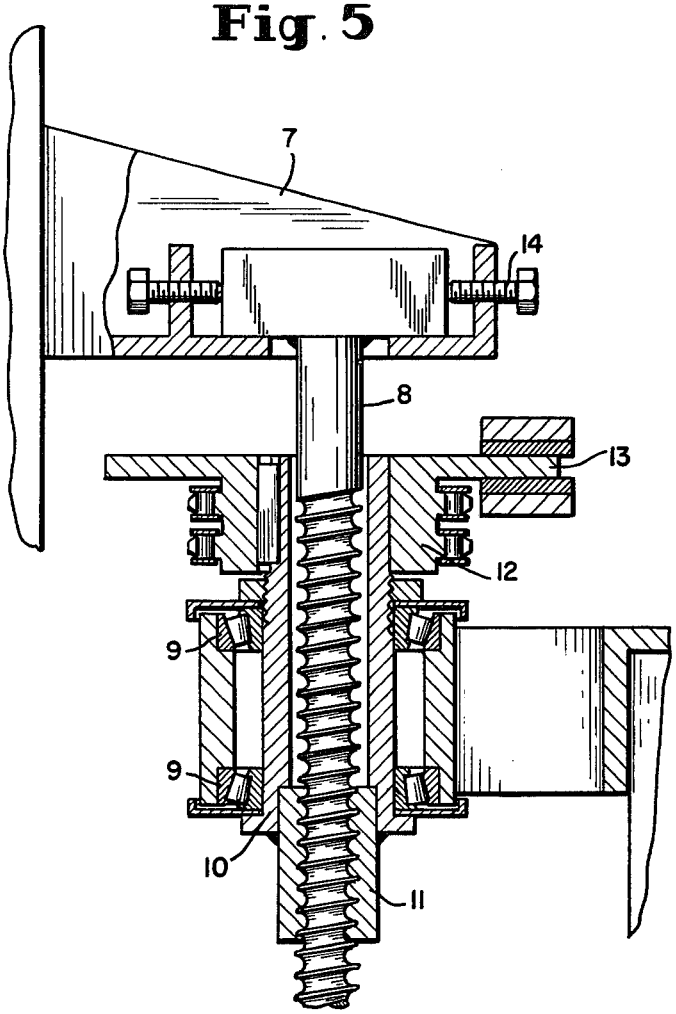
FIG. 5 is an exploded view of a means incorporated in the arrangement of FIG. 1 for the purposes of controlling both the speed and path of movement of the so-called car or platform.

The ball screw 8 of each screw assembly is attached at each end onto the frame 2 whereby to allow for support thereof. The screws 8, located preferably at each corner of the car 1 and with a nut attached to each corner of the car, are supported at each end thereof by angular contact roller races. In other words, and as illustrated in FIG. 5 for example, to each corner of the car or cage 1 a mounting bracket and associated hub 7 are attached with tapered roller thrust bearings 9 supporting a hollow shaft 10 to which is attached a Saginaw type nut 11. Also attached to the hollow shaft 10 is a sprocket 12 having a brake disc 13 attached thereto.

The upper mounting brackets 7, as specifically illustrated in FIG. 5, are in the form of a fabricated bracket member adapted to be attached to vertical channel members provided on the lift frame 2 whereby to support the Saginaw screws 8. In a preferred arrangement these upper brackets are provided with suitable adjustment means, as for example illustrated at 14 in FIG. 5, whereby to allow the screws 8 to be aligned correctly in relation to the frame 2. The brackets 7 provided for housing the lower ends of the screws 8 may be of a similar construction to the aforementioned upper brackets, or may alternatively be provided or fitted with so-called "floating" attachments to allow for correct relative alignment of the screws 8.

In the arrangement illustrated the sprockets 12 attached to the upper ends of the screws 8 are rotated, by means of an appropriate drive system to be described in more detail hereinafter, whereby to cause the car or cage 1 to rise or descend as required dependent upon the direction of rotation. As the four sprockets 12 must be rotated to either raise or lower the car or cage 1, there is no free fall condition of the type which is known to exist with so-called conventional elevators. As such, a compensating counterweight will not be required.

Figure 4:
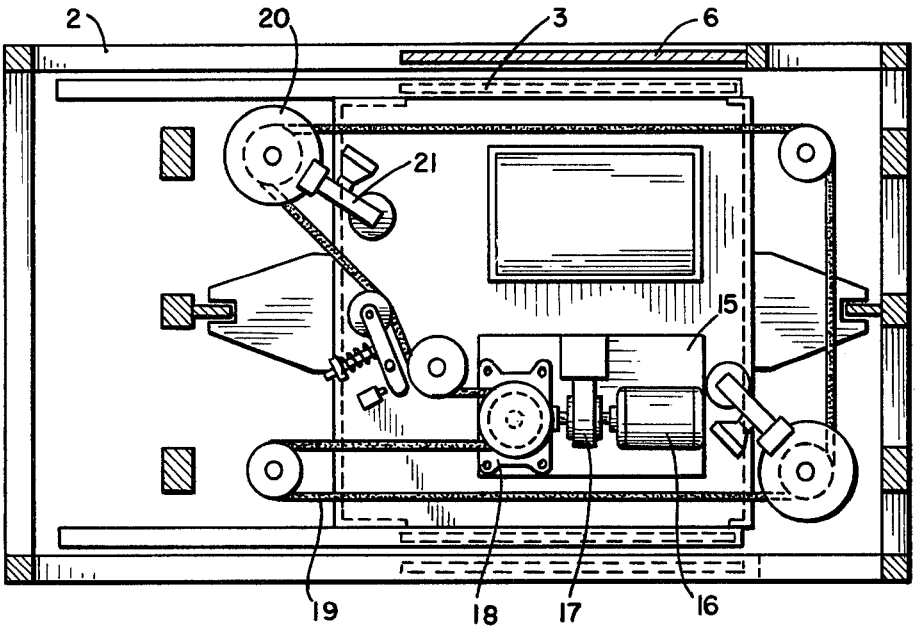
FIG. 4 is a view from above of the load transfer system of FIG. 1 showing in more detail the drive means utilised for purposes of imparting movement to the so-called car or platform means.

At the top of the outer frame 2, or alternatively at the top of the car or cage 1, there is provided a sub-base 15 (see FIG. 4). Located on this sub-base 15 are a drive motor 16, drum coupling and solenoid breaking means 17 and a reducing gearbox 18. In an especially preferred embodiment the drive motor 16 will be in the form of a single phase motor connected, via a suitable power coupling 17, to a 90-degree gear reducer 18 (adapted for example to provide approximately 3:1 transmission ratio). In practice the power coupling 17 ensures the existence of a short period of dwell before the onset of full torque to the gearbox 18, thereby allowing for what may be termed, in layman's language, a "soft" start-stop effect. The output shaft from the reduction gearbox 18 in turn is adapted to drive chains 19 and sprockets 20 in a circular fashion to each of the Saginaw nuts 11, hereby imparting upward or downward motion to the ar or carriage.

For domestic usage, a single phase electric motor may preferably be employed. However, when the unit s adapted for use as, for example, a service lift for shops and factories, three phase current may then be employed, with the result that a three phase motor will be appropriate.

For convenience insofar as actual construction, maintenance and servicing is required, the appropriate motor 16, reduction gearbox 18 and associated sprockets 20 are mounted on the top of the car or cage 1.

In a preferred embodiment there is provided adequate space between the car 1 and the frame 2 whereby to allow for access therein of personnel. Such space may be utilised either as an emergency exit or for purposes of maintenance. The car 1 may furthermore have a removable panel provided therein whereby to allow for ready access to the space. A ladder or ladders provided on the frame 2 and a door, manually or electrically operated, provided at the bottom of the frame 2 would then complete the arrangements allowing for escape in an emergency or under conditions of power failure.

In order to allow for control of the load transfer system a number of electrical controls may be provided. Such controls would include a demand button at each level and a start-stop button in the car or cage 1 itself. Furthermore the frame 2 may be provided with so-called limit switches at each level thereof, with these switches being operable to de-energise the drive means upon arrival of the car or cage 1 at a respective floow of the overall structure. An appropriate communication system, as for example a telephone, may be installed in the car or cage 1 whereby to allow for communication with persons outside that car 1 in times of emergency.

The aforegoing description may be seen to refer in some detail to what may be considered to be the basic features of the present applicant's arrangement. However, it should be noted that a number of additional features may be included as desired, for purposes of overall safety and the comfort of the user.

For example, the car or cage 1 may be equipped with lighting of any known type. Preferably however, all lighting and controls are of the low voltage type. The car or cage 1 may also be equipped with a battery standby for emergency lighting, as for example for use in the instance of power failure.

Furthermore, the or each entry door may be fitted with electrical solenoid locks which are adapted to lock when de-energised such that, in the instance of power failure, entry cannot be gained unless the car or cage 1 is actually present at the level of entry.

A further preferred feature of the present arrangement resides in the provision of a means for detecting and reacting to fracture of each chain of the assembly. In one such arrangement (not shown) a basic frame and pivot pin may be adapted to support two sprockets on spring-loaded arm members whereby to tension the or each drive chain. In the instance of chain breakage or fracture, the relevant arm will revolve under spring pressure whereby to actuate a micro-switch operable to stop the drive motor and hence arrest the motion of the car or cage 1.

In a further preferred embodiment, two buffers are fitted at the base of the frame 2 in order to protect against the possibility of over-run of the car 1.

Caliper type disc brakes 21 (see FIG. 4) may also be fitted to alternate Saginaw nuts 11. In the instance of power failure these disc brakes 21 will hold against release until actually released by a service man or alternatively upon resumption of the power supply.

Finally, it is to be understood that the aforegoing description refers merely to preferred embodiments of the present invention and that variations and modifications are possible without departing from the spirit and scope of the invention, the ambit of which is to be determined from the following claims.

What is claimed is:

1. Self-supporting and self-contained apparatus capable of being preassembled and placed into an existing well or space provided in a structure, said apparatus being for the transfer of loads between vertically spaced-apart levels of a structure, said apparatus including (a) support frame means;

(b) platform means for supporting a load, said platform means being accessible from one side thereof or from two sides thereof, said two sides being opposite to each other;

(c) guide means extending between said levels and rigidly affixed to said support frame means to constitute a path for movement of said platform means between said levels; said guide means including at least two elongated, stationary screws, each of said screws being threaded within a revolving circulating ball nut; each ball nut being fixed to a sleeve formed with a central bore having a diameter greater than the screw thickness, to maintain said screw and said sleeve spaced apart from each other; each of said sleeves being attached to a sprocket and being supported within a bearing means, said bearing means being rigidly connected to said platform means; and (d) drive means associated with said platform means and operable to simultaneously drive each of said sprockets and thereby cause each ball nut to revolve around the respective stationary screw whereby movement is imparted to said platform means.

2. The apparatus of claim 1, wherein said guide means includes four of said elongated, stationary screws, one at each corner of said platform means.

3. The apparatus of claim 1, wherein said platform means is in the form of a box-like cage or enclosure having a sliding-door arrangement provided on the front and rear sides thereof.

4. The apparatus of claim 3, wherein said drive means is adapted to be mounted on the uppermost surface of said platform means.

5. The apparatus of claim 4, wherein said drive means is in the form of a single phase motor which is adapted to be connected, via power coupling means, to a gear reducer, said gear reducer in turn being in drive connection with each of said sprockets.

6. The apparatus of claim 4, wherein said drive means is in the form of a three-phase motor which is adapted to be connected, via power coupling means, to a gear reducer, said gear reducer in turn being in drive connection with each of said sprockets.

* * * * *